US005950577A

United States Patent [19]

Sasaki et al.

[11] Patent Number: 5,950,577

[45] Date of Patent: Sep. 14, 1999

[54] WATER PUMP

[75] Inventors: Norio Sasaki, Aichi-ken; Mitsutoshi Hagiwara, Anjyo; Yasuo Ozawa, Kariya; Itsuro Hashiguchi, Toyota, all of Japan

[73] Assignee: Aisin Seiki Kabushiki Kaisha, Aichi-pref, Japan

[21] Appl. No.: 09/110,860

[22] Filed: Jul. 7, 1998

Related U.S. Application Data

[63] Continuation of application No. 08/720,147, Sep. 25, 1996, Pat. No. 5,836,271.

[30] Foreign Application Priority Data

Sep. 29, 1995 [JP] Japan ..... 7-253851

[51] Int. Cl.[6] ..... F01P 5/10

[52] U.S. Cl. ..... 123/41.44; 415/168.1

[58] Field of Search ..... 415/168.1, 168.2, 415/170.1, 175, 177; 123/41.44, 41.54

[56] References Cited

U.S. PATENT DOCUMENTS

| | | | |
|---|---|---|---|
| 1,474,454 | 11/1923 | Telfer | 415/58.4 |
| 4,065,232 | 12/1977 | Stratienko | 417/368 |
| 5,355,847 | 10/1994 | Ozeki | 123/41.44 |

FOREIGN PATENT DOCUMENTS 43 18 158 A1 2/1994 Germany .

*Primary Examiner*—Willis R. Wolfe
*Assistant Examiner*—Brian J Hairston
*Attorney, Agent, or Firm*—Hazel & Thomas, P.C.

[57] ABSTRACT

A water pump is provided with pressure-feed means whereby coolant that has leaked into the space between a bearing and a seal member in a pump housing is forcibly fed into an radiator reservoir tank in order to be recovered.

1 Claim, 4 Drawing Sheets

WATER PUMP

This application is a Continuation of nonprovisional application Ser. No. 08/720,147 filed Sep. 25, 1996, now U.S. Pat. No. 5,836,271.

BACKGROUND OF THE INVENTION

This invention relates to a water pump effective for use in cooling a water-cooled engine, particularly the water-cooled engine of an automotive vehicle.

A conventional water pump includes a housing, a rotary shaft freely rotatably supported in the housing via a bearing, an impeller fixedly secured to one end of the shaft, and a seal member provided between the impeller and the bearing. The seal member separates the bearing from a working chamber accommodating the impeller. A disadvantage with this seal member is that when the coolant evaporates, it is difficult for this seal member to prevent evaporated coolant from escaping. The result is leakage of coolant to the bearing side of the seal member. Such leakage of coolant into the bearing causes a decline in bearing durability. To solve this problem, Japanese Utility Model Application Laid-Open No. 3-56899 proposes a water pump in which the housing is provided with a discharge passageway that connects the space between the seal member and the bearing to the outside, thereby preventing fluid that has leaked from the seal member from reaching the bearing.

With this conventional water pump, however, the coolant that has leaked is discharged to the exterior of the housing. This results in a reduction in the amount of coolant available and, hence, a degradation in the system's cooling capability.

SUMMARY OF THE INVENTION

Accordingly, one object of the present invention is to provide a water pump in which coolant that has leaked from the seal member can be reliably recovered.

According to the present invention, the foregoing object is attained by providing a water pump comprising a housing, a shaft freely rotatably supported in the housing via a bearing, an impeller fixedly secured to one end of the shaft, a seal member provided between the impeller and the bearing, and pressure-feed means for forcibly feeding coolant, which has leaked into a space situated between the bearing and the seal member, into a radiator reservoir tank, the rotary shaft being rotated by an external driving force to circulate the coolant through the pump.

In an embodiment of the invention, the housing is provided with a first chamber that connects with a lower portion of the above-mentioned space and a second chamber one end of which connects with the first chamber and another end of which is sealed by a closure member. A first check valve is disposed at one end of the first chamber for allowing passage of fluid from the first chamber to the second chamber and for blocking passage of fluid from the second chamber to the first chamber. The second chamber is connected to the radiator reservoir tank via a second check valve for blocking passage of fluid to the second chamber and allowing passage of fluid from the second chamber. Coolant that has leaked into the space is forcibly fed into the radiator reservoir tank by pressure rising in the second chamber that accompanies the temperature of the coolant rising.

In a preferred embodiment, the second chamber is provided with a pump mechanism that performs a pumping operation as a result of the rotary shaft rotating.

In a preferred embodiment, a variable-volume space whose volume is varied by a temperature-sensitive member that expands and contracts with a change in coolant temperature is connected with the lower portion of the above-mentioned space. A first check valve is disposed between the variable-volume space and the above-mentioned space for blocking passage of fluid from the variable-volume space to the above-mentioned space and for allowing passage of fluid from the above-mentioned space to the variable-volume space. The variable-volume space is connected to the radiator reservoir tank via a second check valve for blocking passage of fluid to the variable-volume space and for allowing passage of fluid from the variable-volume space.

Thus, in accordance with the water pump of the present invention, fluid that leaks into the space is fed under pressure to the radiator reservoir tank in order to prevent any decrease in the amount of coolant in the system.

Other features and advantages of the present invention will be apparent from the following description taken in conjunction with the accompanying drawings, in which like reference characters designate the same or similar parts throughout the figures thereof.

DESCRIPTION OF THE PREFERRED EMBODIMENTS

Embodiments of a water pump according to the present invention will now be described in detail with reference to the accompanying drawings.

Figure 1:
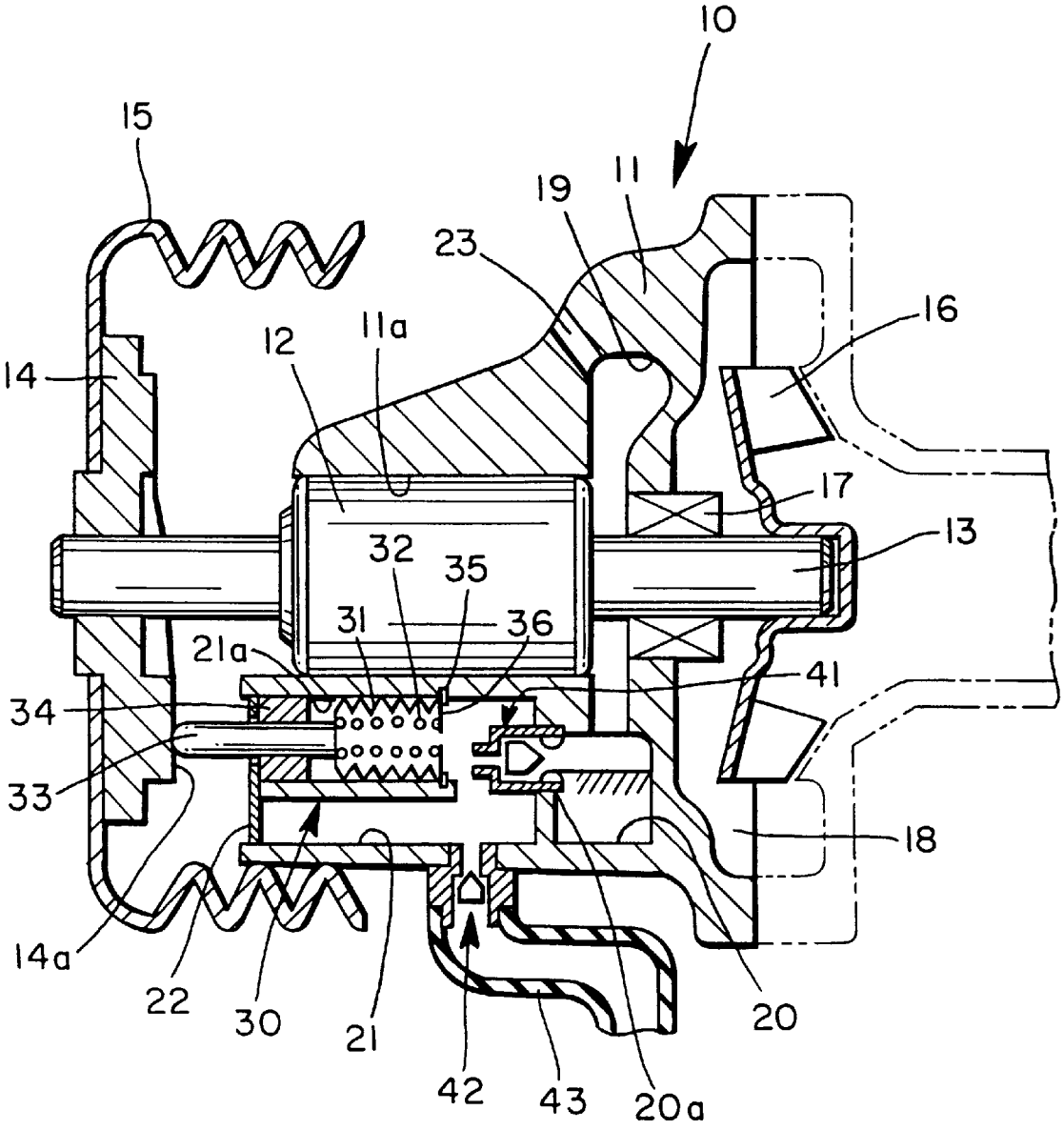
FIG. 1 is a longitudinal, sectional view illustrating a water pump according to a first embodiment of the present invention.

FIG. 1 illustrates a first embodiment of the present invention. As shown in FIG. 1, a water pump 10 includes a housing 11 secured to a cylinder block, which is not shown. The housing 11 has a central hole 11*a* in which a rotary shaft 13 is rotatably supported via a bearing 12. A drive pulley 15 is fixedly secured to one end of the rotary shaft 13 via a pulley bracket 14, and an impeller 16 is fixedly secured to the other end of the rotary shaft 13. A mechanical seal (seal member) 17 is disposed between the impeller 16 and the bearing 12 and prevents coolant from leaking to the side of the bearing 12 from a working or pump chamber 18 accommodating the impeller 16.

A diametrically extending space 19 is formed in the housing 11 between the bearing 12 and the mechanical seal 17. A first chamber 20 for collecting coolant that has leaked via the mechanical seal 17 is formed in the lower portion of the space 19. A second chamber 21 is formed in the housing 11 so as to lie substantially parallel to the hole 11*a*. The second chamber 21 is provided below the hole 11*a* and is spaced away from the hole. The second chamber 21 has one side connected to the first chamber 20 via a passageway 20*a* formed in the housing 11. The other side of the second chamber 21 is open to the atmosphere. The upper portion of the space 19 communicates with the atmosphere via a vent hole 23 formed in the housing 11.

An internal cylinder is formed as an integral part of the housing 11 in the second chamber 21 and has a hole 21*a*. A pump mechanism 30 that is part of a pressure-feed means, according to a characterizing feature of the invention is accommodated within the hole 21*a* of the internal cylinder. It should be noted that the internal cylinder need not necessarily be formed as part of the housing 11 but may be formed as a separate member that is secured inside the second chamber 21.

The pump mechanism 30 comprises a bag-like diaphragm 31, which consists of a resilient member made of rubber or the like, and a spring 32. The diaphragm 31 has an opening whose end face is in abutting air-tight contact with an annular plate 36 fastened to a fastening member 35 fitted into the inner peripheral surface of the hole 21*a* on the side of the first chamber 20. The diaphragm 31 has a closed end to which a rod 33 is connected. One end of the spring 32 is fastened to the annular plate 36 and the other end of the spring 32 is fastened to the bottom portion of the diaphragm 31. The spring 32 biases the rod 33 via the diaphragm 31 so that the rod normally projects outwardly from the hole 21*a*. A closure plate 22 is fitted, air- and liquid-tightly, into the opening of the second chamber 21 on the side towards the atmosphere. The closure plate 22 has a through-hole in which the rod 33 is fitted. Further, a cylindrical guide member 34 having an inner peripheral surface that guides the rod 33 is fitted into the hole 21*a*. The projecting end of the rod 33 is brought into resilient abutting contact with the end face of the pulley bracket 14 on the side facing of the housing 11 by means of the biasing force of spring 32. The contacted surface of the pulley bracket 14 is formed to have a protrusion or cam 14*a* the height of which changes in a continuous fashion. When the pulley bracket 14 rotates, the rod 33 reciprocates continuously and causes the diaphragm 31 to expand and contract, thereby varying the pressure inside the second chamber 21.

A first check valve 41 for allowing passage of fluid from the first chamber 20 to the second chamber 21 and for blocking passage of fluid from the second chamber 21 to the first chamber 20 is disposed in the passageway 20*a*. The bottom of the second chamber 21 connects with a radiator reservoir tank 44 via piping 43. A second check valve 42 for allowing passage of fluid from the second chamber 21 to the piping 43 and for blocking passage of fluid from the piping 43 to the second chamber 21 is disposed in the connection to the piping 43. The two check valves 41 and 42 are floating type valves that are opened and closed by the flow of the fluid. The radiator reservoir 44 is connected to a radiator (not shown) for cooling a flow of coolant from an engine.

The operation of the first embodiment constructed as set forth above will now be described.

When the rotary shaft 13 is driven by the drive pulley 15, the impeller 16 rotates inside the working chamber 18 so that coolant is drawn in from a coolant intake port (not shown) and discharged from a coolant discharge port (not shown). Vaporous droplets of the coolant then enter the interior of the space 19 from a gap between the mechanical seal 17 and rotary shaft 13. The vaporous part of the coolant escapes from the top of the housing via the vent hole 23. The condensed part of the coolant migrates to the bottom of the space 19 and collects in the first chamber 20.

As mentioned above, the rod 33 reciprocates repeatedly as a result of the pulley bracket 14 and the drive pulley 15 rotating. This causes the diaphragm 31 to expand and contract repeatedly so that the pressure inside the second chamber 21 vary periodically. In other words, the interior of the second chamber 21 develops positive and negative pressure in a periodic fashion. As a result, when the coolant accumulates to a level (higher than that shown in FIG. 1) near the first check valve 41 inside the first chamber 20, the coolant is drawn into the second chamber 21 via the first check valve 41 and is discharged into the piping 43 via the second check valve 42 as a result of a change in pressure inside the second chamber 21 caused by the pump mechanism 30. As a result, there is no back-flow of leaked coolant from the second chamber 21 to the first chamber 20 or from the interior of the piping 43 to the second chamber 21. The leaked coolant is recovered by being forcibly fed to the radiator reservoir tank (not shown), thereby preventing the loss of available coolant.

Figure 2:
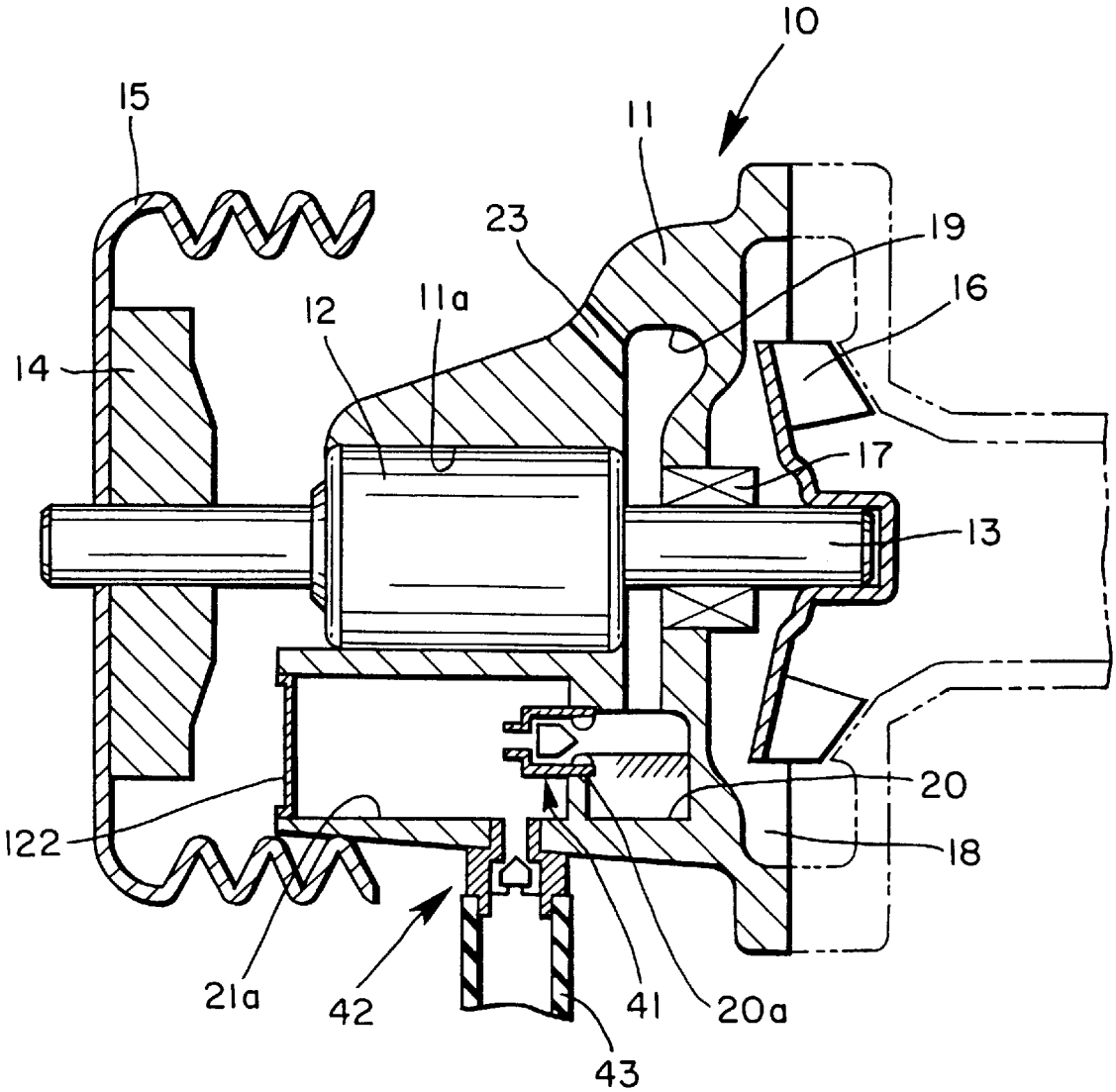
FIG. 2 is a longitudinal sectional view illustrating a water pump according to a second embodiment of the present invention.

FIG. 2 illustrates a second embodiment of a water pump in accordance with the present invention. In this embodiment, the pump mechanism of the first embodiment is not provided inside a second chamber 21*a,* and the open end of the second chamber 21*a* on the atmospheric side is air- and liquid-tightly closed by a closure member 122. In this embodiment, the first check valve 41, second check valve 42 and sealed second chamber 21*a* correspond to the pressure-feed means of the present invention. Other elements are the same as those of the first embodiment and need not be described again.

In the second embodiment, vaporous droplets of the coolant enter the interior of the space 19 from a gap between the mechanical seal 17 and rotary shaft 13. The vaporous part of the coolant escapes from the top of the housing via the vent hole 23. The condensed part of the coolant migrates to the bottom of the space 19 and collects in the first chamber 20. This is similar to the operation of the first embodiment.

Air is contained in the second chamber 21*a*. When the engine runs, the coolant temperature and the temperature of the cylinder block rise and the air in the second chamber 21*a* expands as a result of the heat transmitted via the housing 11. The air contracts caused by a drop in the coolant temperature and the cylinder block temperature when the engine stops. Accordingly, the fluid in the second chamber 21*a* is discharged into the piping 43 at the time of expansion and the fluid in the first chamber 20 is drawn into the second chamber 21*a* by negative or suction pressure produced inside the second chamber 21*a* at the time of contraction.

Coolant that has accumulated to a level (higher than that shown in FIG. 2) near the first check valve 41 inside the first chamber 20 during operation of the engine is drawn into the second chamber 21*a* via the first check valve 41 as a result of the cooling and contraction of the air inside the second chamber 21*a* when the engine is turned off. When the engine is subsequently re-started and the air inside the second chamber 21*a* expands as a result of heating, the coolant that was drawn into the second chamber 21*a* is discharged into the piping 43 via the first check valve 41. Thus, in this embodiment, coolant that has leaked is fed under pressure to the radiator reservoir tank by the heating and cooling of the engine when the engine is operated and then shut down. This makes it possible to recover the coolant thereby preventing a loss in the amount of available coolant.

Figure 3:
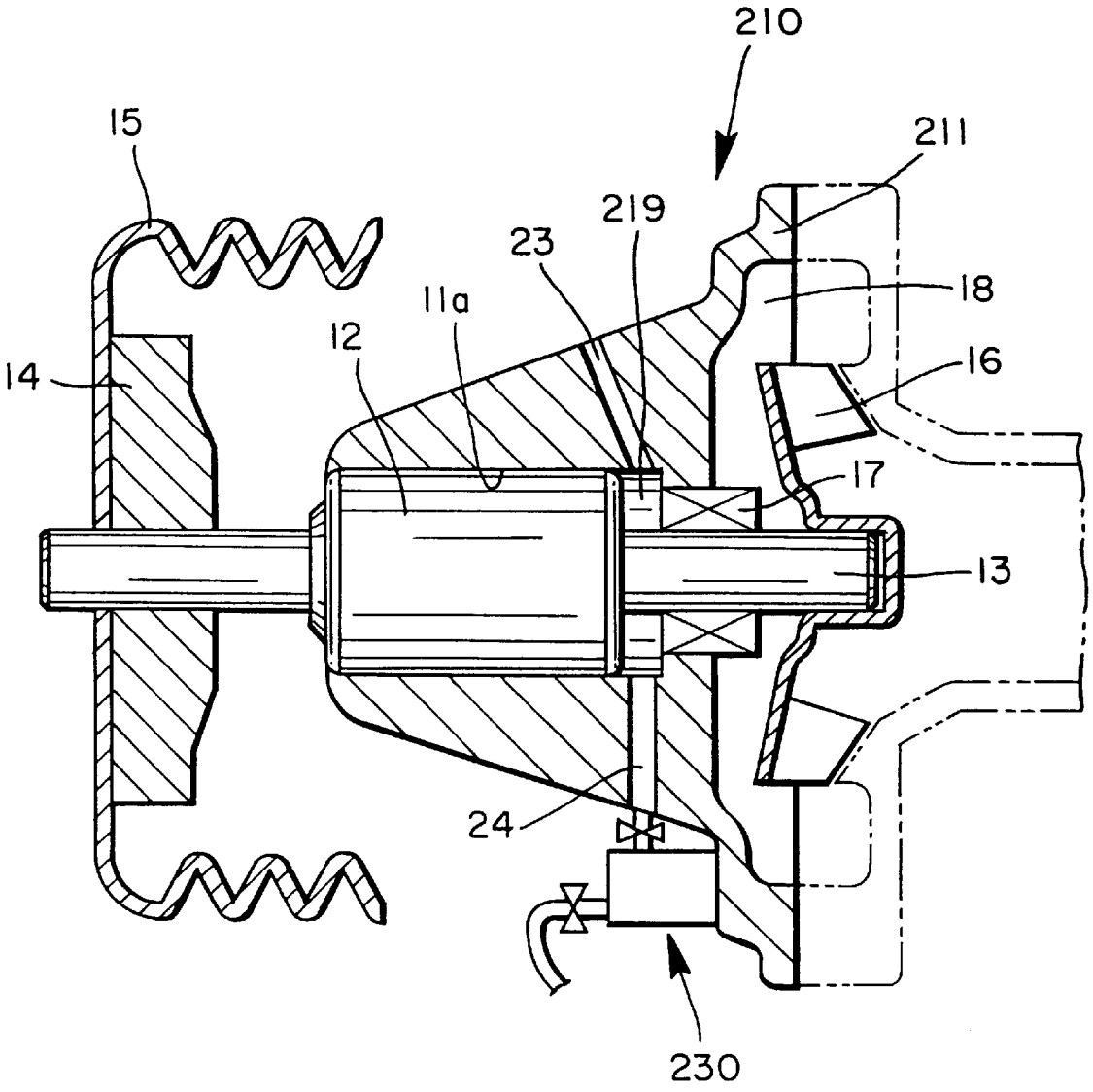
FIG. 3 is a longitudinal sectional view illustrating a water pump according to a third embodiment of the present invention.
Figure 4:
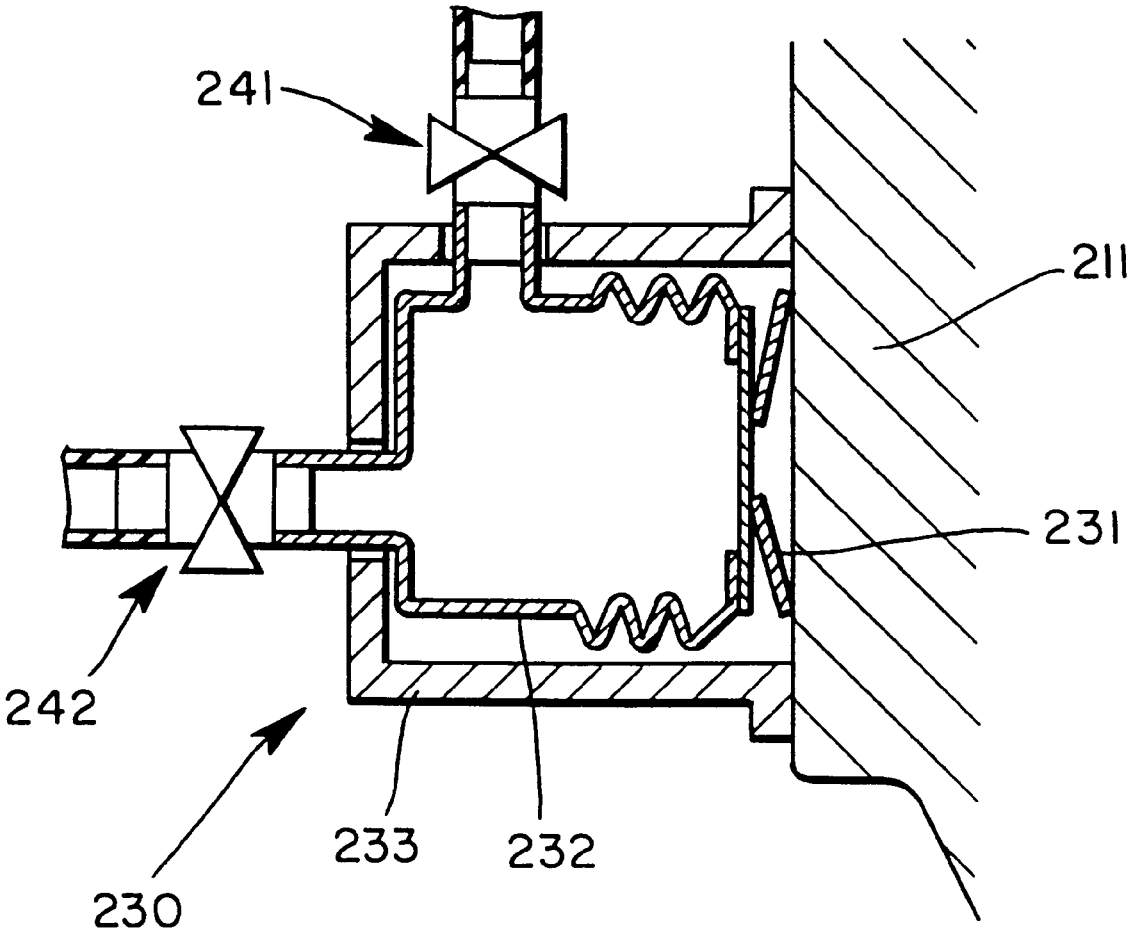
FIG. 4 is a sectional view showing a pump mechanism as included in the water pump of FIG. 3.

FIGS. 3 and 4 illustrate a third embodiment of the invention. In this embodiment, a discharge hole 24 extending downward from a space 219 between the bearing 12 and mechanical seal 17 is formed in a housing 211, and the vent hole 23 extending upward from the space 219 is formed in the housing 211.

The housing 211, which is secured to a cylinder block (not shown), has a flange secured to a pump mechanism 230 shown in FIG. 4. The pump mechanism 230 comprises a body 233 secured to the housing 211, a bimetal plate 231 which abuts against the housing 211 and which expands or contracts based on the temperature of the housing 211, a resilient bag-shaped member 232 provided in the axial direction by a bellows portion so that the volume of the bag-shaped member can be varied by the bimetal plate 231, a first check valve 241 disposed in the piping that connects the discharge hole 24 with the interior of the bag-shaped member 232, for allowing passage of fluid from the discharge hole 24 to the interior of the bag-shaped member 232 and for blocking passage of fluid in the opposite direction, and a second check valve 242 disposed in piping that connects the interior of the bag-shaped member 232 with the radiator reservoir tank (not shown) for allowing the passage of fluid from the interior of the bag-shaped member 232 to the radiator reservoir tank and for blocking passage of fluid in the opposite direction. Both check valves may be of the same type as those of the foregoing embodiments. Other elements are similar to those of the first embodiment and need not be described again.

When the coolant temperature rises during operation of the engine in this embodiment, the bimetal plate 231 elongates and causes the internal volume of the bag-shaped member 232 to decrease. As a result, the pressure within the bag-shaped member 232 rises so that a discharge action occurs. At this point, the first check valve 241 is closed by the internal pressure of the bag-shaped member 232. Coolant that has leaked accumulates in the discharge hole 24 and piping. When a large amount of coolant accumulates, the first check valve 241 opens against the internal pressure and allows the coolant into the bag-shaped member 232. When the engine is turned off and the coolant temperature falls, the bimetal plate 231 contracts and negative or suction pressure develops in the space inside the bag-shaped member 232. As a result, the coolant that accumulated in the discharge hole 24 and piping is drawn into the bag-shaped member 232 via the first check valve 241. When the engine is subsequently restarted and the coolant temperature rises, the bimetal plate 231 elongates, the above-mentioned discharge effect occurs and the coolant that was drawn into the bag-shaped member 232 via the first check valve 241 is impelled into the radiator reservoir tank (not shown) via the second check valve 242.

Thus, in this embodiment, coolant that has leaked is fed under pressure to the radiator reservoir tank by the effect of heating and cooling when the engine is operated and then shut down. This make it possible to recover the coolant and prevent any loss in the amount of available coolant.

Different forms of the pressure-feed means of the present invention are described in the three embodiments set forth above. However, the pressure-feed means can be implemented in various other forms as well. For example, in the third embodiment, an arrangement can be adopted in which the discharge hole connects to the radiator reservoir tank by piping that comprises a non-resilient member. The piping is divided into sections along its length and the divided sections of the piping are connected by connection piping formed from a resilient member such as rubber tubing. A first check valve that blocks passage of fluid to the discharge hole is disposed on the discharge hole side of the connection piping, and a second check valve which blocks passage of fluid to the connection piping side is disposed on the radiator reservoir tank side of the connection piping. A bimetal element is wound upon the outer periphery of the connection piping between the two check valves and one end of the bimetal element is made to contact the housing of the water pump. Due to expansion and contraction of the bimetal element, the internal volume of the connection piping changes. As in the second embodiment describe above, coolant that has leaked is fed under pressure to a radiator reservoir tank by the heating and cooling when the engine is operated and then shut down. This make it possible to recover the coolant and prevent any loss in the amount of available coolant.

Thus, in accordance with the present invention described above, coolant that has leaked into the space between a bearing and a seal member is impelled into a radiator reservoir tank by pressure-feed means, thus enabling the coolant to be recovered. Degradation in the capability of the cooling system due to insufficient levels of coolant is thereby prevented.

Since many apparently widely different embodiments of the present invention can be made without departing from the spirit and scope thereof, it is to be understood that the invention is not limited to the specific embodiments described above, except as defined in the appended claims.

What is claimed is:

1. A water pump comprising:

a housing defining a working chamber;

a rotary shaft freely rotatably supported in the housing via a bearing;

an impeller fixedly secured to one end of said rotary shaft and accommodated in said working chamber;

a seal member provided between said impeller and said bearing, within said housing and around said rotary shaft, said housing having further defined therein a space between said bearing and said seal member;

pressure-feed means for forcibly feeding coolant that has leaked into said space into a radiator reservoir tank, wherein said pressure-feed means is mounted on the body of the water pump and produces a positive pressure in a pressure variable chamber connected to a coolant induced space;

drive means for rotating said rotary shaft to circulate the coolant; and a space defined by a resilient member by which the space is expanded or contracted depending upon a change in temperature.

* * * * *

UNITED STATES PATENT AND TRADEMARK OFFICE

CERTIFICATE OF CORRECTION

PATENT NO. : 5,950,577
DATED : September 14, 1999
INVENTOR(S) : Sasaki *et al.*

It is certified that error appears in the above-identified patent and that said Letters Patent is hereby corrected as shown below:

Title page:

Item [73 ], please insert --Toyota Jidosha Kabushiki Kaisha
Aichi-ken, Japan --as one of the Assignees Signed and Sealed this First Day of August, 2000

*Attest:*

*Attesting Officer*

Q. TODD DICKINSON

*Director of Patents and Trademarks*